US005767822A

United States Patent [19]

Hiroshi

[11] Patent Number: 5,767,822

[45] Date of Patent: Jun. 16, 1998

[54] SCROLLING DISPLAY METHOD AND SYSTEM THEREFOR

[75] Inventor: Yajima Hiroshi, Zushi, Japan

[73] Assignee: Avix Inc., Yokohama, Japan

[21] Appl. No.: 501,504

[22] Filed: Jul. 12, 1995

[30] Foreign Application Priority Data

| | | | |
|---|---|---|---|
| Oct. 25, 1994 | [JP] | Japan | 6-260139 |
| May 18, 1995 | [JP] | Japan | 7-119732 |

[51] Int. Cl.[6] ..... G09G 3/20

[52] U.S. Cl. ..... 345/46; 345/31

[58] Field of Search ..... 345/44, 46, 56, 345/82, 123, 124, 189, 31; 352/100; 40/610, 447, 450, 451, 452, 463

[56] References Cited

U.S. PATENT DOCUMENTS

| | | | |
|---|---|---|---|
| 4,470,044 | 9/1984 | Bell | 340/755 |
| 4,689,604 | 8/1987 | Sokol | 340/755 |
| 5,027,112 | 6/1991 | Ross et al. | 340/792 |
| 5,302,965 | 4/1994 | Belcher et al. | 345/31 |
| 5,406,300 | 4/1995 | Tokimoto et al. | 345/31 |

*Primary Examiner*—Mark R. Powell
*Attorney, Agent, or Firm*—Pennie & Edmonds LLP

[57] ABSTRACT

A scrolling display system has a plurality of light emitting cell array segments, each being consisted of a given number of light emitting cells arranged in alignment with a given dot interval, the plurality of light emitting cell array segments being arranged in one of column and row directions in spaced apart relationship for forming a display plane, an interval of adjacent light emitting cell array segments being greater than the given dot interval, an image memory storing an image data to be displayed on the display plane, the image data containing pixel information for all pixels to form dot matrix on the display plane with the given dot interval in column and row directions, and a display controller reading out data fractions of the image data corresponding to respective of light emitting cell array segments and supplying the data fractions to respective light emitting cell array segments for driving light emitting cell array segments, the display controller controlling shifting of display image in the one of column and row directions for adjusting scroll speed depending upon the interval between adjacent light emitting cell array segments.

18 Claims, 8 Drawing Sheets

IMAGE MEMORY
TIMING CLOCK GENERATOR CIRCUIT
2
3
4
A1
A2
A3
A4
DS1
DS2
DS3
DS4
DRIVE CIRCUIT
in
OUT
IN
SR1
SR2
SR3
SR4
1

A1
A2
Ai
DS1
DS2
DSi
53
52
51
DRIVE CIRCUIT
LATCH CIRCUIT
SHIFT REGISTER
OUT
IN
1
2
3
54
55
PROCESSOR
IMAGE MEMORY
SR

SCROLLING DISPLAY METHOD AND SYSTEM THEREFOR

BACKGROUND OF THE INVENTION

1. Field of the Invention

The present invention relates generally to a method and a system for displaying characters and/or graphic images. More specifically, the invention relates to a novel method and a system for displaying a character or characters and/or graphic images on a light emitting cell array, in which light emitting cells such as high-intensity light emitting diodes (LEDs) and so forth are arranged in a form of a two-dimensional array, in a scrolling manner.

2. Description of the Related Art

A dot matrix type display panel, in which a plurality of light emitting cells, such as LEDs are arranged in a two-dimensional array with a regular interval, has been widely spread. In case of a simple LED display panel, such as those used in guidance display in a train, advertisement display of a shop and so forth, an image, mainly a string of characters, is displayed on a display panel of a limited size. For instance, bit map type character string data, in which each individual character is formed by 16×16 dots, are sequentially generated; the characters string represented by the generated bit map type character string data is displayed on a dot matrix type display panel having 16 dots in a vertical direction and at least several times of 16 dots in a direction, in a scrolling manner.

In case of a scrolling display system employing a laterally elongated dot matrix type display panel displaying a character string by scrolling in the lateral direction as set forth above, it is naturally necessary to increase the number of dots of the display panel in the lateral direction, in order to increase the number of characters to be displayed simultaneously. This inherently causes substantial cost increase even in the simple display panel.

Also, if the interval between the light emitting cells a two-dimensional array is increased to expand the size of the display panel, displayed image becomes quite rough and thus the display quality can be significantly degraded. Therefore, for enlarging the size of the display panel, it is common to increase number of light emitting cells, instead of increasing the interval between the light emitting cells. In such case, it is preferred to make resolution of the display image higher such that one individual character is formed by 32×32 dots. By this, large size and high quality display can be made. However, this causes significant cost. In addition, in a conventional dot matrix type display panel, a plurality of light emitting cells are mounted on a substrate and housed in a flat panel type casing together with a drive circuit, irrespective of the size of the display panel. Typically, the display panel is rigid and cannot be flexible to be folded freely, disassembled into small fractions, expanded or contracted. Therefore, while quite small size display panel may be hand carried as whole unit, this type of display panel is typically fixed at a predetermined position. Such configuration of the system borders expansion of the application of such display system.

SUMMARY OF THE INVENTION

Therefore, it is an object of the present invention to provide a method and a system for scroll displaying, which permits large size and high resolution visual image display with lesser number of light emitting cells.

Another object of the present invention is to provide a scroll display method and system which can take flexible configuration permitting folding, disassembling, expanding and contracting instead of taking rigid configuration of a display panel having slightly greater dimension that a display size.

According to the first aspect of the invention, a scrolling display method comprises the steps of:

providing n in number of light emitting cell array segments, each being formed by arranging m in number of light emitting cells with fine intervals;

forming a strip form physical region consisted of n in number of the light emitting cell array segments in spaced apart relationship to each other;

n in number of the light emitting cell array segments forming the strip form physical region being spaced from adjacent segments with an interval which is much greater than the interval between the light emitting cells;

(m×n) in number of the light emitting cells included in the strip form physical region being driven according to a bitmap form image data with scrolling the display image from one end of the strip form physical region to the other end;

the bitmap type image data being prepared with respect to a virtual display region of which pixels are arranged in m dots in a column direction and w dots in a row direction, the w being integer multiple of n; and at every moment, (m×n) dots light emitting cells being driven by (m×n) dot of data in the strip form physical region nominally regarded as the virtual display region.

The light emitting cell array segments may be arranged in substantially parallel relationship with substantially constant intervals. Alternatively, the light emitting cell array segments may also be arranged in substantially parallel relationship with given intervals different at different position in the strip form physical region.

Preferably, a period required from driving a first light emitting cell array segment with m dot column data which is a fraction of the image data and corresponding to pixels to be displayed by one light emitting cell array segment, to driving adjacent second light emitting cell array segment with the same m dot column data, is controlled to be proportional to the interval between the first and second light emitting cell array segments.

In the examples of construction, at least a part of light emitting cell array segments may be arranged radially or in triangular wave fashion.

Preferably, data extraction operation is performed upon reading out the image memory stored in a memory for driving (m×n) in number of light emitting cells, which extraction operation is carried our in such a manner that:

the image data is virtually developed on the virtual display region regarded to have (m×w) dot pixel construction;

the developed image data is virtually overlapped with the light emitting cell array segments; and data for m dots overlapping to the positions of m in number of light emitting cells in each light emitting cell array segment are extracted; and wherein the data extraction operation is repeated with slightly shifting the position of the image data to be developed on the virtual display region in the scrolling direction.

According to the second aspect of the present invention, a scrolling display method comprises the steps of:

constructing a light emitting cell array segment by arranging a plurality of light emitting cells with constant intervals d1;

arranging the light emitting cell array segments in parallel with constant intervals d2 which is multiple of the d1 or more;

preparing a bitmap image data having columns with dot construction corresponding to respective light emitting cells in the light emitting cell array segments; and driving the light emitting cell array segments by supplying data for respective columns in the image data for displaying, with a time difference being provided for column data to be supplied to respective light emitting cell array segments in such a manner that when (i)th column of the light emitting cell array segment is driven with (j)th column data for display, (i+1)th of the segment is driven with (j−a)the column data, wherein i is a number given for the light emitting cell array segments in order of arrangement, j is a number given to respective column data of the image data, and a is an integer to be arbitrarily set at a value greater than or equal to two corresponding to d2.

The value a may be an integer substantially equal to (d2/d1).

In the preferred application, the image data includes characters, and each character is formed with b in number of columns of the column data, and (b/a) is greater than or equal to 1. Then, updating period of the column data supplied to respective light emitting cell array segments may be less than or equal to (1/4b). Also, the updating period of the column data supplied to the light emitting cell array segments may be smaller as (b/a) becomes smaller.

It is possible that the bitmap form image data includes dynamic image factor varying in time sequence.

According to the third aspect of the invention, a scrolling display system comprises:

a plurality of light emitting cell array segments, each being formed with m in number of light emitting cells arranged in alignment with fine intervals, the light emitting cell array segments forming a strip form physical region consisted of n in number of the light emitting cell array segments in spaced apart relationship to each other;

n in number of the light emitting cell array segments forming the strip form physical region being spaced from adjacent segments with an interval which is much greater than the interval between the light emitting cells;

(m×n) in number of light emitting cells included in the strip form physical region being driven according to a bitmap form image data with scrolling the display image from one end of the strip form physical region to the other end;

the bitmap type image data being prepared with respect to a virtual display region of which pixels are arranged in m dots in a column direction and w dots in a row direction, the w being integer multiple of n; and at every moment, (m×n) dots light emitting cells being driven by (m×n) dot of data in the strip form physical region nominally regarded as the virtual display region.

According to the fourth aspect of the invention, a scrolling display system comprises:

a plurality of light emitting cell array segments, each being formed with a plurality of light emitting cells arranged in alignment with a given smaller interval d1, the light emitting cell array segments being arranged in parallel with a given larger interval d2 which is multiple of d1 or more;

a bitmap image data having columns with dot construction corresponding to respective light emitting cells in the light emitting cell array segments;

the light emitting cell array segments being driven by supplying data for respective columns in the image data for displaying, with a time difference being provided for column data to be supplied to respective light emitting cell array segments in such a manner that when (i)th column of the light emitting cell array segment is driven with (j)th column data for display, (i+1)th of the light emitting cell array segment is driven with (j−a)th data, wherein i is a number given for the light emitting cell array segments in order of arrangement, j is a number given to respective column data of the image data, and a is an integer to be arbitrarily set at a value greater than or equal to two corresponding to d2.

The light emitting cell array segment may be secured separately and independently from the other of the segments. Alternatively, they may be coupled together through a collapsible link mechanism allowing the segments to gather close proximity with each other, may be attached to a flexible elongated sheet, or may be connected with each other by a plurality of flexible strips.

According to the fifth embodiment of the invention, a scrolling display method comprises the steps of:

forming a light emitting cell array segment by arranging a plurality of light emitting cells in a spaced apart with a first interval and aligned relationship;

arranging a plurality of the light emitting cell array segments in spaced apart relationship with a second interval greater than the first interval to form a display plain;

storing an image data representative of an image to be displayed on the display plain;

reading out data fractions of the image data, each of the data fraction corresponding to an image fraction to be displayed on one individual light emitting cell array segment, with thinning data fractions corresponding to the image fractions to be displayed in a space corresponding to the second intervals; and shifting the position of the image on the display plain in a predetermined magnitude per every display cycle for scrolling display of the image at a scroll speed determined depending upon the second interval.

The light emitting cell array segments may be arranged in parallel relationship on a common plain with a substantially constant interval. Alternatively, the light emitting cell array segments may be arranged in parallel relationship on a common plain with different intervals at different positions on the display screen. The scroll speed may be proportional to the second interval versus the first interval.

The image data may be established with respect to the display plain virtually including vertical dots existing at the interval of the light emitting cell array segments. The image data may be read out per a given bit of fraction data whose number of bits correspond to number of light emitting cells included in the individual light emitting cell array segment.

Preferably, the scroll speed is set at possible minimum speed at the ratio of the second interval versus the first interval.

According to the sixth aspect of the invention, a scrolling display system comprises:

a plurality of light emitting cell array segments, each being consisted of a given number of light emitting cells arranged in alignment with a given dot interval, the plurality of light emitting cell array segments being arranged in one of column and row directions in spaced apart relationship for forming a display plain, an interval of adjacent light emitting cell array segments being greater than the given dot interval;

an image memory storing an image data to be displayed on the display plain, the image data containing pixel information for all pixels to form dot matrix on the display plain with the given dot interval in column and row directions; and a display controller reading out data fractions of the image data corresponding to respective of light emitting cell array segments and supplying the data fractions to respective light emitting cell array segments for driving light emitting cell array segments, the display controller controlling shifting of display image in the one of column and row directions for adjusting scroll speed depending upon the interval between adjacent light emitting cell array segments.

In one embodiment, the light emitting cell array segment is secured separately and independently from the other of the segments. Alternatively, the light emitting cell array segments may be coupled together through a link mechanism shifting adjacent light emitting cell array segments for varying relative position therebetween for forming the display plain at the expanded position. Still alternatively, the light emitting cell array segments are fixed on a flexible sheet with the interval greater than the given dot interval.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed in terms of the preferred embodiments with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
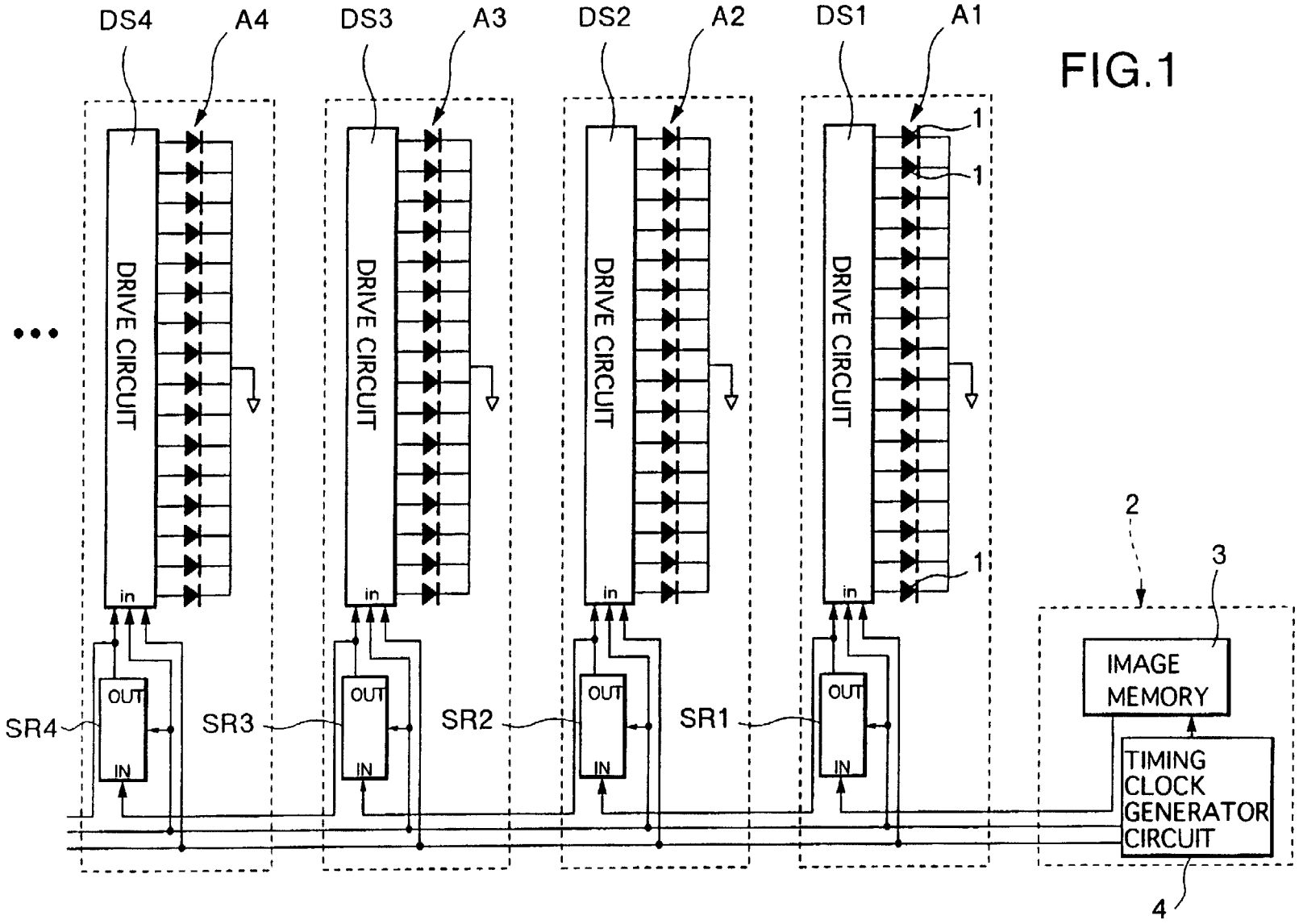
FIG. 1 is a schematic block diagram of a data transmission system in one embodiment of a scrolling display system according to the present invention.
Figures 2A, 2B, 2C, 2D, 2E, 2F:
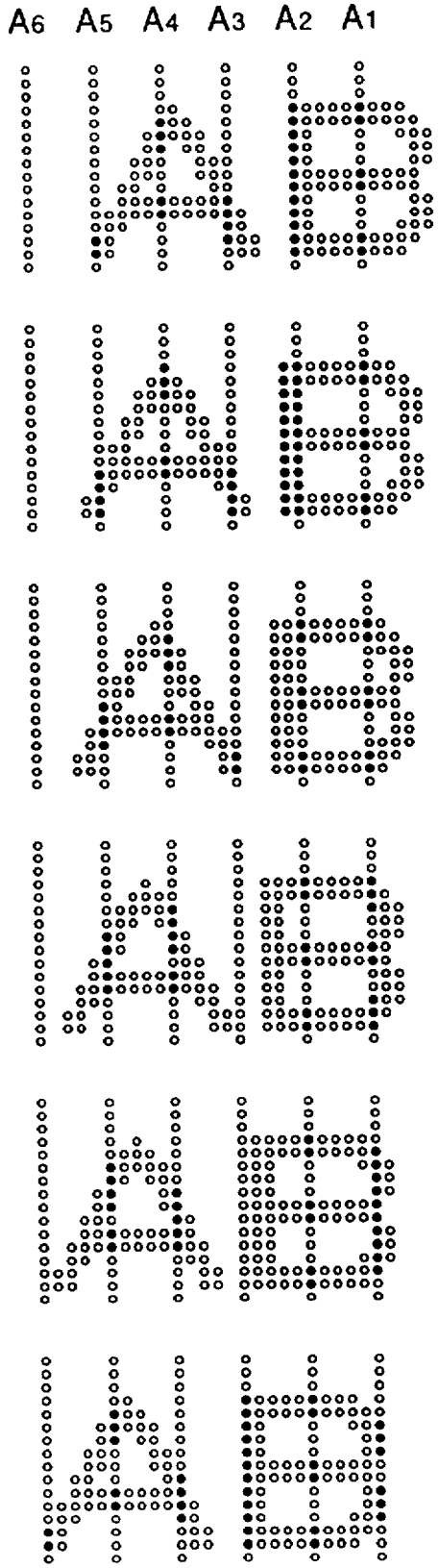
FIGS. 2(A) to 2(F) are an explanatory illustration showing principle of the preferred embodiment of a scrolling display method according to the invention.

FIG. 1 shows one embodiment of a data transmission system to be employed in the preferred embodiment a scrolling display system according to the present invention. In the shown embodiment, 16 in number of LEDs 1 are arranged in alignment along a straight axis in a small interval d1 to form an individual bar-like light emitting cell array segment A1, A2, A3, . . . . Respective light emitting cell array segments A1, A2, A3, . . . are arranged on a common plain in parallel relationship to each other with a given interval d2 which is greater than the interval d1. In practice, the interval d2 in the shown embodiment is set to be five times greater than the interval d1.

For each light emitting cell array segment Ai (i=1, 2, 3, . . . ), 16 bit drive circuit DSi is associated. The drive circuit DSi is formed by integrating a 16 bit shift register and a latch driver. Also, for each drive circuit DSi, 80 bit (16×5 bits) of shift register SRi is provided. An output terminal OUT of the (i)th shift register SRi is connected to an input terminal IN of the (i+1)th shift register SRi+1. In this manner, all of the shift registers SRi are connected in series. Also, the output terminal OUT in respective light emitting cell array segment is connected to the input (in) of the drive circuit DSi.

The input terminal IN of the first stage shift register SRi is connected to a data output of an image memory 3 of a central control unit 2. Also, the overall data transmission system operates in synchronism with a clock from a timing clock generator circuit 4 in the central control unit 2.

Here, it is assumed that bit map type image data of character strings are preliminarily stored in the image memory 3, in which each individual character is constituted of 16×16 dots. In the 16×16 dot image data, each 16 dot data corresponding to each light emitting cell array fraction will be hereinafter referred to as column data. Respective of the column data are represented by D1, D2, D3, . . . in order, and are generally referred to as Di.

The central control unit 2 reads out respective column data in series from the image memory 3 and input to respective shift register string SRi connected in series sequentially. Each shift register SRi serves as a delay circuit of 80 bits (16×5 bits) so that each column data is input to the corresponding drive circuit DSi with a delay in the extent of 5 columns of the column data Dj from inputting to the input terminal IN. The timing clock generator circuit 4 reads out 16 bits of the column data from the image memory 3 and simultaneously supplies a latch signal for all of the drive circuits DSi. Namely, each column data of the image data are supplied to respective drive circuits in each light emitting cell array segment in order so that 16 in number of the LEDs 1 in the light emitting cells array segment are driven for display according to the 16 bits column data latched in the drive circuit.

At this time, by the data delay action of the shift register SRi, the following control in time sequence is performed. When (i)th light emitting cell array segment A1 is driven to display the column data Dj of the (j)th column, the next adjacent (i+1)th light emitting cell array segment Ai+1 is driven to display the column data Dj−5 of the (i−5)th column. As can be appreciated herefrom, for respectively adjacent light emitting cell array segments, the column data are supplied with a time difference corresponding to every five columns.

The relation between the light emitting cell array segment Ai and the column data Dj is diagrammatically illustrated in FIGS. 2(A) to 2(F). The example shown in FIG. 2 is to display two characters of "AB", in which each character is displayed as 16×16 dot bitmap type image. In FIGS. 2(A) to 2(F), the characters "AB" as scrolled are shown in overlapping with six light emitting cell array segments Ai to Ai+5. In the illustration, black dots represent the dots illuminated for displaying fractions of the character image to be displayed. As set forth, each character is expressed as 16×16 dot bitmap image, which requires sixteen light emitting cell array segments for displaying the character image. However, in the shown embodiment, the 16×16 dot bitmap image is displayed by three light emitting cell array segments. Therefore, at each moment, only thee column data among sixteen column data consisting one bitmap character image are displayed. The scroll speed, in the shown embodiment, is set at four characters per seconds. In this way, owing to interpolating function in the human brain, the displayed image with scrolling at the speed of four characters per seconds, the displayed character can be seen as the character consisted of 16×16 dot bitmap.

The principle of shown embodiment of the scrolling display system will be discussed hereinafter for facilitating better understanding of the present invention.

It is considered that the conventionally known typical dot matrix type display panel which is assumed to have 16 dots in the vertical direction and 128 dots in the lateral direction to form the laterally elongated panel. Of course, the interval between the dots in the vertical and lateral directions are equal to each other. The display panel is constituted of 128 in number of light emitting cell segments arranged in parallel relationship with an equal interval. The image data of the character in a form of 16×16 dot bitmap image is sequentially supplied to the display panel to perform display of the character image with scrolling in the lateral direction. In the shown example, the scroll speed is set to display four characters per second so that eight characters can be displayed simultaneously. This scroll speed is much higher speed than normal or ordinary character scroll speed.

In the display panel, every five columns of the light emitting cell array segments are made active, in other words, four columns of the light emitting cell array segments located between two active light emitting cell array segments are held not active. More concretely, when the first column of the light emitting cell array segment is active for displaying image, next second to fifth columns of the light emitting cell arrange segments are held inactive, the sixth column of the light emitting cell arrange segment is active, the seventh to tenth columns of the light emitting cell arrange segments are held inactive. In similar manner, sixteenth, twenty-first, twenty-sixth . . . light emitting cell arrange segments are made active. When numbers given to respective columns in order of arrangement is m, the number of each active light emitting cell arrange segment can be expressed by m=5n+1, wherein n is an integer, in the 128 columns of the light emitting cell arrange segments. Therefore, in the shown case, 25 columns out of 128 columns of light emitting cell arrange segments are made active. Remaining 103 columns of the light emitting cell arrange segments are held inactive. At this condition, the character string is displayed normally in scrolling manner. Then, despite of the fact that four columns out of five columns are held inactive and thus do not contribute in formation of the display image, the human eye can see the scrolled character image as if all of columns of the light emitting cell arrange segments are active.

In the normal display state where all columns of the light emitting cell arrange segments are active, the character image is displayed with sixteen columns of the light emitting cell arrange segments, i.e. 16×16 dot light emitting cell array. In contrast, in the shown embodiment, only three columns out of the sixteen columns of light emitting cell arrange segments are active. Therefore, at a moment, only fractions of the character image, which cannot be recognized as intended character image, can be visible. However, when the character image is scrolled at a speed higher than or equal to a predetermined scroll speed, the character image can be clearly recognized. In this case, the character image recognized is substantially comparable with the character image displayed on the 16×16 dot light emitting cell array.

This can be achieved by the aid of interpolating function of the human brain in recognizing the object seen through the eyes. Namely, by the interpolation in the human brain as seeing the moving image, the fraction of the image which cannot be seen, is filled-up to complete the seen image.

In the shown embodiment, each light emitting cell arrange segment is formed by arranging sixteen light emitting cells in alignment. The light emitting cells are arranged at an interval d1. 25 in number of the light emitting cell arrange segments are arranged in parallel with a given interval d2 greater than the interval d1 of the light emitting cells. In the shown embodiment, the interval d2 is set to be five times of the interval d1. Then, the character string in the dot matrix of 16×16 dots per one character is sequentially supplied as the column data to the light emitting cell arrange segments for driving to display. At this time, supply of the column data is controlled in the order of arrangement so that when (i)th light emitting cell array segment A1 is driven to display the column data Dj of the (j)th column, the next adjacent (i+1)th light emitting cell array segment Ai+1 is driven to display the column data Dj−5 of the (i−5)th column. As can be appreciated herefrom, for respectively adjacent light emitting cell array segments, the column data are supplied with a time difference corresponding to every five columns.

Assuming that the ratio of the interval d2 between the light emitting cell arrange segments versus the interval d1 of the light emitting cells is (a) and the one character is consisted of b columns of column data, it is preferred to set (b/a) to be greater than or equal to 1. On the other hand, updating period of the column data to be supplied to respective light emitting cell arrange segments is set to be smaller than or equal to (1/4b) seconds. When (i)th light emitting cell array segment A1 is driven to display the column data Dj of the (j)th column, the next adjacent (i+1)th light emitting cell array segment Ai+1 is driven to display the column data Dj−5 of the (i−5)th column. Smaller value of (b/a) requires lower value of (1/4b). When (b/a) is greater, higher visibility can be obtained. However, it required greater number of light emitting cells. On the other hand, higher visibility can be attained at higher scroll speed. However, since shifting speed of the character becomes higher, difficulty can be encountered in reading the character. Therefore, even when the value of (b/a) is small, satisfactory visibility can be certainly obtained when the scroll speed is high. That is, when the scroll speed is sufficiently high, satisfactory visibility can be obtained even at (b/a)=1.

The relationship between the ratio of the interval d2 between the light emitting cell arrange segments versus the interval d1 of the light emitting cells and the scroll speed may be set appropriately depending upon operating condition of the scrolling display system.

It should be noted that while the foregoing embodiment employs the shift register as the delay line for the image data to drive respective light emitting cell arrange segments with the column data having a predetermined relationship in time sequence, the present invention should not be limited to the shown circuit construction.

For instance, it is possible to read out 16 bit column data as one word and to transfer and latch the predetermined column in respective drive circuits within one display period to easily form time relationship of the flow of the data similar to the foregoing embodiment. When the circuit system distributing respective column data to respective drive circuit from the image memory per each one display cycle, it becomes possible to incorporate dynamic image factor in the image data. Namely, in parallel to the process distributing data to respective drive circuit from the image memory, rewriting of the data in the image memory can be performed to vary the image in time sequence, the image to be displayed in scroll manner can be varied as dynamic image.

Figure 5:
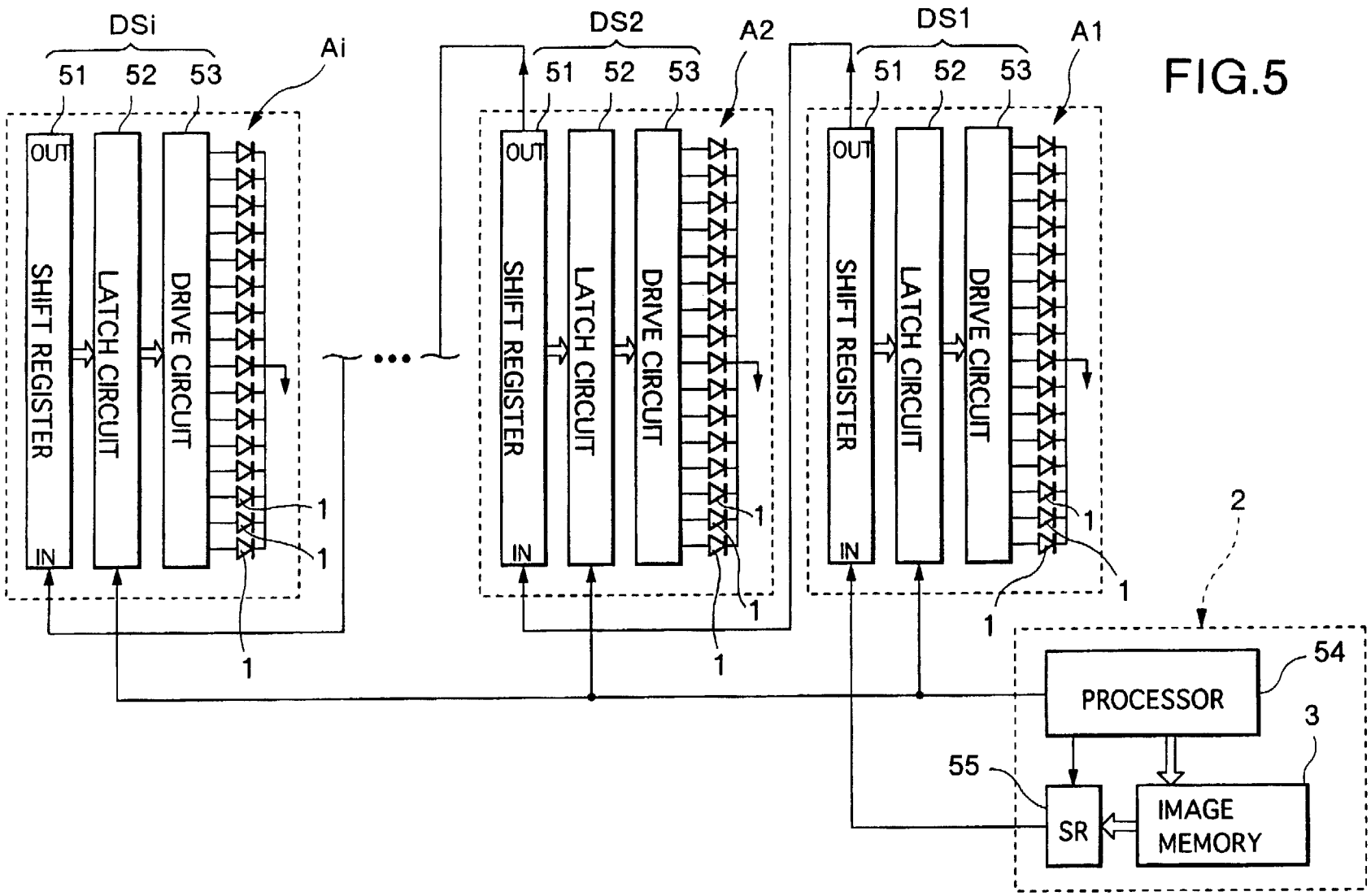
FIG. 5 is a block diagram showing a data transmission system in another embodiment of a scrolling display system according to the invention.
Figure 6:
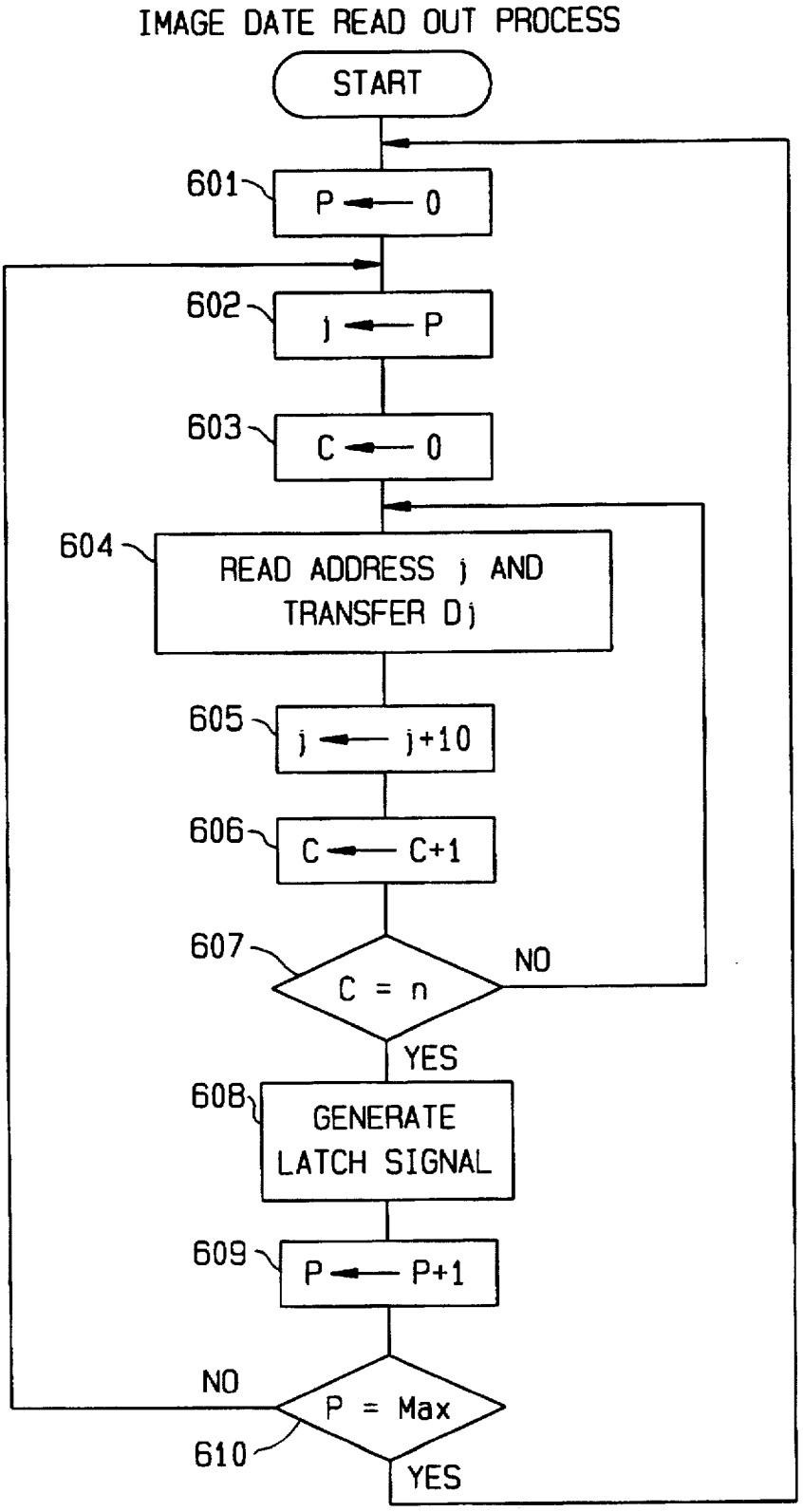
FIG. 6 is a flowchart showing a process of reading out of an image data in the embodiment of FIG. 5.

The embodiment of the type set forth above is illustrated in the block diagram of FIG. 5 and the flowchart of FIG. 6. As shown in FIG. 5, 16 in number of LEDs 1 are arranged in alignment at the given interval d1 to provide n in number of light emitting cell arrange segments A1, A2, A3, . . . An. Respective of the light emitting cell arrange segments are arranged in parallel at an internal d2 which is ten times of the interval d1, for example. For each light emitting cell arrange segment Ai (i=1, 2, 3, . . . n), 16 bit drive circuit DSi is provided. The drive circuit DSi is formed by integrating a 16 bit shift register 51, a 16 bit latch circuit 52 and a 16 bit driver 53. Therefore, respective shift registers 51 in n in total of drive circuits DSi are connected in series, (16×n) bit shift register is formed as a whole.

In the image memory 3 of the central control unit 2, the bitmap type image data of 16 bit in vertical direction and free in the lateral direction is stored. The column data corresponding to each of the light emitting cell arrange segment are given number D1, D2, D3, . . . in order. The number of the column data is generally referred to as Dj. The image memory 3 is constructed in one word=16 bits, and column data Dj is stored in the address j.

The processor 54 of the central control unit 2 makes access the image memory 3 for reading out in a manner discussed hereinbelow. The 16 bit column data Dj read out from the image memory 3 as parallel data is converted into serial data through a shift register 55 for parallel/serial conversion. Then, the converted serial data is input to the (16×n) bit shift register constituted of n in number of 16 bit shift registers. By serial input of the n columns of column data to the (16×n) bit shift register from the central control unit 2, 16 bit column data are supplied to n in number of 16 bit shift registers 51. At this timing, the central control unit 2 provides a latch signal to respective drive circuits DSi to shift the data in the shift registers 51 to the latch circuits 52. Then, respective LEDs 1 in respective light emitting cell arrange segments are driven by the drivers 53. Simultaneously, data in respective shift registers 51 are updated. By repeating the foregoing operation, scrolling display is performed.

FIG. 6 shows a flowchart showing control process in accessing the image memory 3 for reading out the data, executed by the processor 54 of the central control unit 2. At a first step 601, a start pointer P which is a pointer identifying display start point, is reset to 0 for initialization. Then, at a step 602, an address pointer j which is a pointer indicative of an address in the image memory 3 to be accessed, is updated with the value of the start pointer P. Initially, since the start pointer P is initialized to be 0, the address pointer j is set to 0. At a step 603, a column counter C which is a point identifies the light emitting cell array segment, is also set to 0.

Next, at a step 604, the address j of the image memory 3 designated by the address pointer j is accessed for reading out the column data Dj. As set forth above, the column data Dj is read out from the image memory 3 as parallel data and converted into the serial data and then transferred to the shift register 51 of the light emitting cell array segment Ai designated by the column counter C. Thereafter, at a step 605, the address pointer j is incremented by 10. As set forth above, since the light emitting cell array segments are arranged in parallel with the interval d2 which is 10 times greater than the interval d1 of the light emitting cells. Therefore, the incrementing value, i.e. 10, corresponds to this value, and which, in turn, corresponds to number of column data to be thinned or skipped from display. Thus, the address of the image memory 3 to be accessed is advanced for 10 column data.

Next, at a step 606, the column counter C is incremented by 1 to shift identification of the light emitting cell array segment Ai+1 to be made active for displaying. Subsequently, at a step 607, the value of the column counter C is checked if the column counter value C reaches the predetermined final value n, or not. If the column counter value C does not reach the predetermined final value n, the process is returned to the step 604 to repeat the foregoing process from the step 604. On the other hand, if the value reaches the predetermined final value, it represents that the column counter value C becomes equal to the predetermined final value n. In such case, the process is jumped to a step 608 to generate the latch signal.

Next, at a step 609, the start pointer P is incremented by 1 to advance the image to be displayed in the scroll direction by one unit. One unit should correspond to the one pitch or interval d1 of the light emitting cells. Then, at a step 610, the value of the start pointer P is checked if it reaches a value MAX indicative of the end of the image. When the value of the start pointer P does not reached the value MAX, the process is returned to the step 602 to perform the foregoing process. On the other hand, when the value becomes equal to the value MAX, the process is returned to the step 601 to repeat the foregoing process.

Here, consideration is given that the arrangement is not necessary to obtain light emitting cell array segments are arranged, and that the light emitting cell array segments are not always arranged at the constant interval. Next, the data in the image memory is read out in the typical control system. Then, by distributing the data to respective light emitting cell array segments, scrolling display can be realized. In short, the image data is virtually developed in a virtual display region nominally regarded as (m×w) dot pixel construction. Thus, the light emitting cells in respective light emitting cell array segments at the positions corresponding to the character image to be displayed are driven by respectively corresponding drive circuits 53. By repeating the foregoing process with incrementing the column counter value, the character can be scrolled in the lateral direction.

Next, discussion will be given for the preferred embodiment of the scrolling display system according to the present invention for implementing the display method set forth above.

Figure 3:
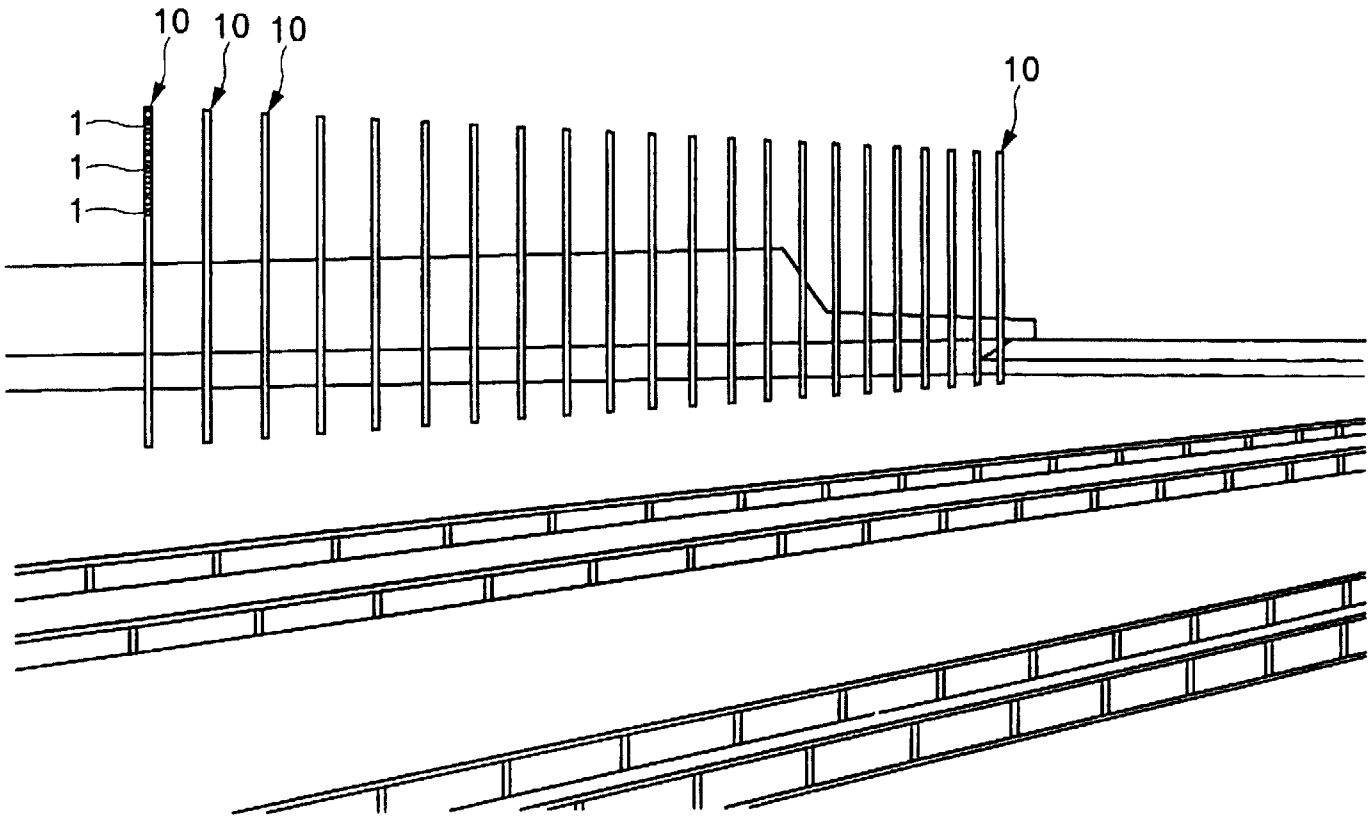
FIG. 3 is a general illustration showing one embodiment of physical construction of the scrolling display system for implementing the scroll display method according to the invention.

For example, scrolling display is performed at a in a race track toward audience by placing the display system at the center field. FIG. 3 generally shows the preferred embodiment of the scrolling display system used in such application. In this case, a bar-shaped display segment 10 is formed by arranging 64 in number of light emitting cells 1, such as high intensity LED aggregated lump in alignment at an interval of 10 cm. The overall length of the bar-shaped display segment 10 is approximately 7 m. A plurality of bar-shaped display segments 10 are vertically implanted by burying the lower end portion into the ground in a depth of 60 cm, for example. In the shown application, 23 in number of the bar-shaped display segments 10 are arranged in parallel relationship to each other on a common plane to form a display plain. The interval of the adjacent bar-shaped display segments 10 is 50 m which is five times greater than the interval of the light emitting cells. Thus, a large size display screen of approximately 6.4 m in height and 11.5 m in width can be formed. With this display screen, 64×115 dot of image can be displayed in scrolling fashion.

In the shown application, while huge display screen can be established, the screen can be easily disassembled into 23 bar-shaped display segments 10. Therefore, transportation, installation and removal of such display screen can be significantly facilitated. Furthermore, such display screen is not subject influence of wind pressure, it does not require high installation strength. Needless to say, the cost for such display system is much lower than the conventional dot matrix type display system.

Figure 4:
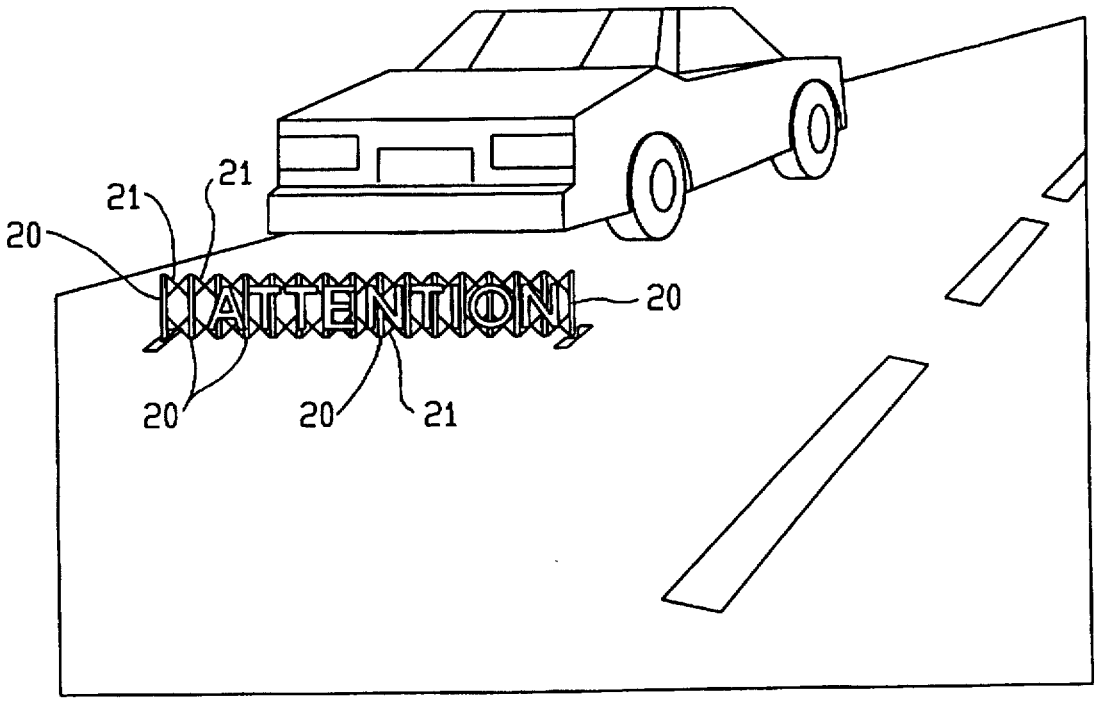
FIG. 4 is a general illustration showing another embodiment of physical construction of the scrolling display system according to the invention.

FIG. 4 shows another and smaller scale application of the preferred embodiment of the display system. In the shown application, the scrolling display system is used as marking of emergency parking, such as emergency stop in traffic accident. The display system may be constantly loaded in an automotive vehicle for use in emergency stop due to failure, accident and so forth. The display system comprises a plurality of bar-shaped display segments 20. In the shown application, the bar-shaped display segment 20 is formed by arranging 16 or 32 LEDs in alignment with a small interval d1. The overall length of the bar-shaped display segment 20 is approximately 40 cm. In the shown example, 16 bar-shaped display segments 20 are employed for forming the display system. The individual bar-shaped display segments 20 are connected to each other via a link mechanism 21 to form an expandable assembly of the bar-shaped display segments 20. The link mechanism 21 permits shifting of the bar-shaped display segments 20 at both ends thereof between an expanded position where the interval d2 between the bar-shaped display segments 20 becomes several times greater than the interval d1 of the LEDs, and a contracted position where the bar-shaped display segments 20 are placed in close proximity to each other. In the shown example, the display system is designed to display a word "ATTENTION" in scrolling manner.

The display system as set forth above can be normally collapsed by placing the link mechanisms 21 in contracted position to facilitate placement in the vehicle. For instance, assuming that the interval d1 between the LEDs is 1 cm and the interval d2 between the bar-shaped display segments 20 at the expanded position of the link mechanisms is 5 cm, the width of the display system in use is 75 cm. Further assuming that the width of the support of the bar-shaped display segment 20 is 1 cm, the display system can be collapsed to have the width of approximately 18 cm while not in use.

Figure 7A:
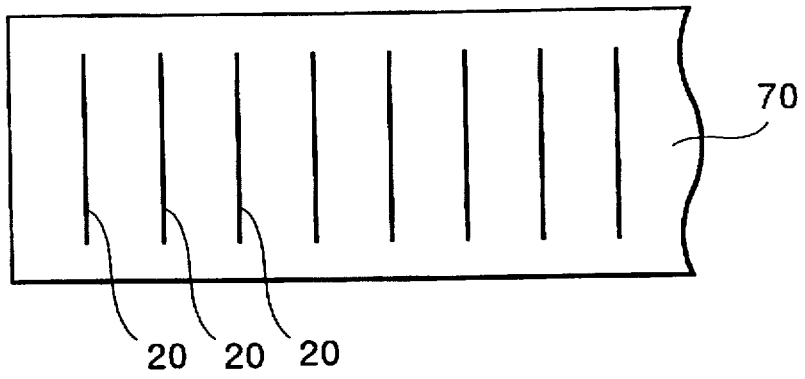
FIGS. 7(A) and 7(B) are general illustrations showing another embodiments of physical constructions of the invention.
Figure 7B:
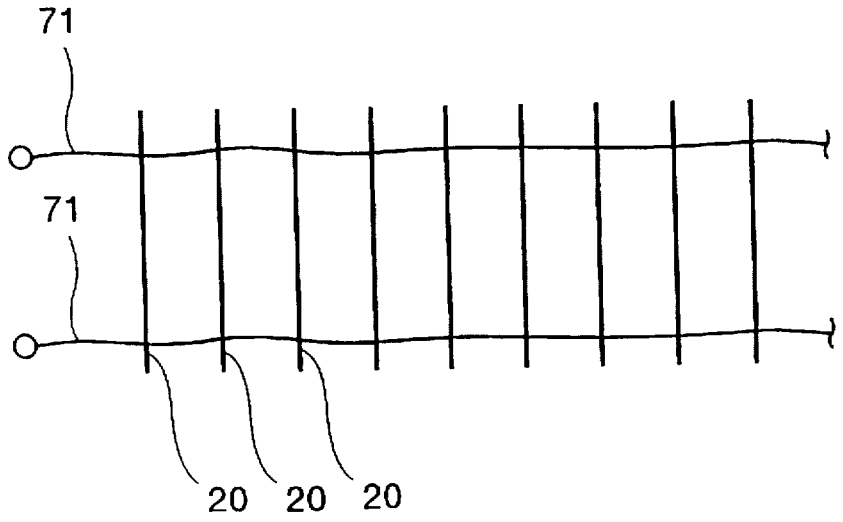

FIGS. 7(A) and 7(B) show examples of modified constructions of the preferred embodiment of the scrolling display system according to the present invention. In the example of FIG. 7(A), a plurality of individual bar-shaped display segments 20 are fixed on an elongated flexible sheet 70 in mutually parallel relationship with a substantially constant intervals. On the other hand, in the example of FIG. 7(B), a plurality of bar-shaped display segments 20 are fixed on a plurality of elongated strips 71 in substantially parallel relationship to each other with substantially constant intervals. In both case, the display systems are constructed as flexible assemblies. Such display system as flexible assembly can be hanged or stretched along a wall of a building for displaying advertisement message, guidance message and so forth. Even in this case, the display system may be folded for facilitating storage while not in use.

Figure 8A:
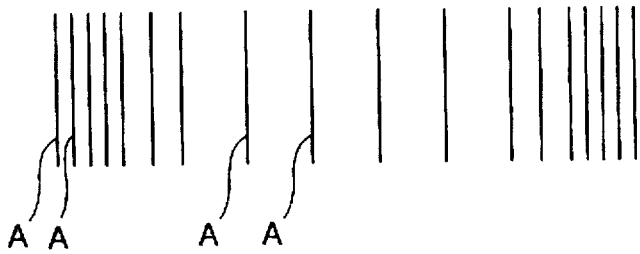
FIGS. 8(A) to 8(D) are general illustrations showing further embodiments of physical constructions of the invention.
Figure 8B:
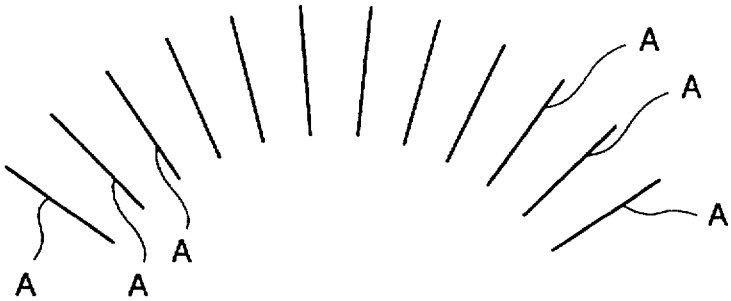
Figure 8C:
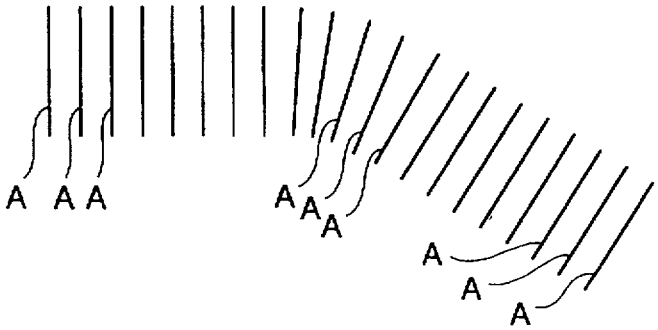
Figure 8D:
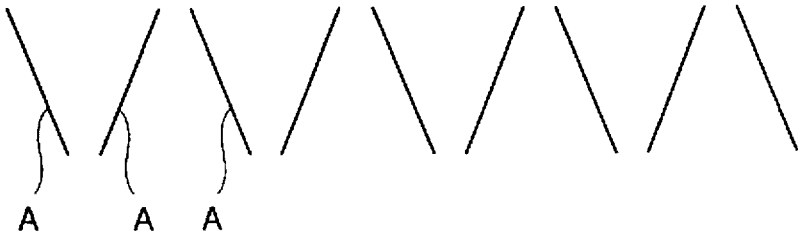

While the foregoing embodiments are directed to the constructions where the light emitting cell array segments or the bar-shaped display segments are arranged in mutually parallel relationship with substantially constant intervals. However, placement of the light emitting cell array segments or the bar-shaped display segments in parallel relationship to each other is not essential to the present invention. Also, the intervals between the light emitting cell array segments or the bar-shaped display segments is not specific to the constant interval. For instance, an example of FIG. 8(A) has an arrangement, in which the light emitting cell array segments A are arranged in parallel to each other but have different intervals at different positions. FIG. 8(B) shows an example, in which the light emitting cell array segments A are arranged radially. FIG. 8(C) shows an example, in which mutually angled two straight portions where the light emitting cell array segments are arranged in parallel relationship to each other, are connected via transition portions where the light emitting cell array segments are arranged radially. FIG. 8(D) shows arrangement, in which a part of or all of light emitting cell array segments are arranged in substantially triangular configuration. With these arrangement, the scrolling display system can be installed on the wall surface of the building, straight member or oblique member of a truss bridge, even when installation position or interval is constrained by various factors.

It should be noted that, in the embodiment of FIG. 1, the radio (d2/d1) of the interval d1 of the light emitting cells of one light emitting cell array segment and the interval d2 is the light emitting cell array segments is 5. In FIG. 3, the ratio (d2/d1) is 10. Greater ratio (d2/d1) results in smaller number of light emitting cells forming the display system. Therefore, effect of the present invention in lowering of cost is significant. At this point, even at the ratio (d2/d1) of 2, substantial cost down effect in comparison with the conventional display system can be attained.

With the present invention, large size and fine image can be displayed in scrolling manner with smaller number of light emitting cells. Also, the display system can be adapted to various constructions. In any case, in comparison with the conventional dot matrix type display panel, fine display performance and large size of the display size can be attained at low cost.

As concrete constructions, a plurality of bar-shaped display segments, each constructed by arranging a plurality of light emitting cells with a small interval, are arranged in parallel relationship with a greater constant intervals within a space. Thus, even in the huge size display, installation and removal of the system becomes quite easy. In addition, even in the huge size display, influence of the wind pressure to the scrolling display system can be made small so as not to require substantial strength of the support structure. Also, the light emitting cell array segments or the bar-shaped display segments are not necessary to be arranged at constant interval with holding parallelism, the display system according to the present invention is applicable in wide range of applications.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A scrolling display method comprising the steps of:

providing n in number of light emitting cell array segments, each being formed by arranging m in number of light emitting cells with fine intervals;

forming a strip form physical region consisted of n in number of said light emitting cell array segments in spaced apart relationship to each other, said light emitting cell array segments being arranged in substantially parallel relationship with given intervals different at different position in said strip form physical region, n in number of said light emitting cell array segments forming said strip form physical region being spaced from adjacent segments with each said given interval which is much greater than said interval between said light emitting cells;

driving (m×n) in number of said light emitting cells included in said strip form physical region according to bitmap form image data with scrolling the display image from one end of said strip form physical region to the other end, said bitmap type image data being prepared with respect to a virtual display region of which pixels are arranged in m dots in a column direction and w dots in a row direction, the w being an integer multiple of n; and driving (m×n) dots light emitting cells with (m×n) dot of data in said strip form physical region which is nominally considered as said virtual display region.

2. A scrolling display method as set forth in claim 1, wherein a period required from driving a first light emitting cell array segment with m dot column data which is a fraction of said image data and corresponding to pixels to be displayed by one light emitting cell array segment, to driving adjacent second light emitting cell array segment with the same m dot column data, is controlled to be proportional to the interval between said first and second light emitting cell array segments.

3. A scrolling display method comprising the steps of:

providing n in number of light emitting cell array segments, each being formed by arranging m in number of light emitting cells with fine intervals;

forming a strip form physical region consisted of n in number of said light emitting cell array segments in spaced apart relationship to each other, said light emitting cell array segments being arranged such that at least a part of said light emitting cell array segments are arranged radially on a substantially common plane or in triangular wave fashion;

n in number of said light emitting cell array segments forming said strip form physical region being spaced from adjacent segments with each said given interval which is much greater than said interval between said light emitting cells;

driving (m×n) in number of said light emitting cells included in said strip form physical region according to bitmap form image data with scrolling the display image from one end of said strip form physical region to the other end, said bitmap type image data being prepared with respect to a virtual display region of which pixels are arranged in m dots in a column direction and w dots in a row direction, the w being integer multiple of n; and driving (m×n) dots light emitting cells with (m×n) dot of data in said strip form physical region which is nominally regarded as said virtual display region.

4. A scrolling display method comprising the steps of:

constructing a light emitting cell array segment by arranging a plurality of light emitting cells with constant intervals d1;

arranging said light emitting cell array segments in parallel with constant intervals d2 which is multiple of said d1 or more;

preparing bitmap image data having columns with dot construction corresponding to respective light emitting cells in said light emitting cell array segments;

driving said light emitting cell array segments by supplying data for respective columns in said image data for displaying, with a time difference being provided for column data to be supplied to respective light emitting cell array segments in such a manner that when (i)th column of said light emitting cell array segment is driven with (j)th column data for display, (i+1)th column of said light emitting cell array segment is driven with (j−a)th column data wherein i is a number given for said light emitting cell array segments in order of arrangement, j is a number given to respective column data of said image data, and a is an integer substantially equal to (d2/d1).

5. A scrolling display method comprising the steps of:

constructing a light emitting cell array segment by arranging a plurality of light emitting cells with constant intervals d1;

arranging said light emitting cell array segments in parallel with constant intervals d2 which is multiple of said d1 or more;

preparing bitmap image data having columns with dot construction corresponding to respective light emitting cells in said light emitting cell array segment, said image data including characters, each character being formed with b in number of columns of said column data, and driving said light emitting cell array segments by supplying data for respective columns in said image data for displaying, with a time difference being provided for column data to be supplied to respective light emitting cell array segments in such a manner that when (i)th column of said light emitting cell array segment is driven with (j)th column data for display, (i+1)th column of said light emitting cell array segment is driven with (j−a)th column data, wherein i is a number given for said light emitting cell array segments in order of arrangement, j is a number given to respective column data of said image data, and a is an integer to be set at a value such that (b/a) is greater than or equal to 1.

6. A scrolling display method as set forth in claim 5, wherein updating period of said column data supplied to respective light emitting cell array segments is less than or equal to (1/4b).

7. A scrolling display method as set forth in claim 5, wherein updating period of said column data supplied to said light emitting cell array segments is smaller as (b/a) becomes smaller.

8. A scrolling display method comprising the steps of:

providing n in number of light emitting cell array segments, each being formed by arranging m in number of light emitting cells with fine intervals;

forming a strip form physical region consisted of n in number of said light emitting cell array segments in spaced apart relationship to each other, n in number of said light emitting cell array segments forming said strip form physical region being spaced from adjacent segments with an interval which is much greater than said interval between said light emitting cells;

driving (m×n) in number of said light emitting cells included in said strip form physical region according to bitmap form image data with scrolling the display image from one end of said strip form physical region to the other end; and said bitmap form image data being prepared with respect to a virtual display region of which pixels are arranged in m dots in a column direction and w dots in a row direction, the w being integer multiple of n, said bitmap form image data including dynamic image factor varying in time sequence; and (m×n) dots light emitting cells by (m×n) dot of data in said strip form physical region which is nominally regarded as said virtual display region.

9. A scrolling display method comprising the steps of:

constructing a light emitting cell array segment by arranging a plurality of light emitting cells with constant intervals d1;

arranging said light emitting cell array segments in parallel with constant intervals d2 which is multiple of said d1 or more;

preparing a bitmap image data having columns with dot construction corresponding to respective light emitting cells in said light emitting cell array segments, said bitmap form image data including dynamic image factor varying in time sequence; and driving said light emitting cell array segments by supplying data for respective columns in said image data for displaying, with a time difference being provided for column data to be supplied to respective light emitting cell array segments in such a manner that when (i)th column of said light emitting cell array segment is driven with (j)th column data for display, (i+1)th column of said light emitting cell array segment is driven with (j−a)th column data, wherein i is a number given for said light emitting cell array segments in order of arrangement, j is a number given to respective column data of said image data, and a is an integer to be arbitrarily set at a value greater than or equal to two.

10. A scrolling display system comprising:

a plurality of light emitting cell array segments, each being formed with m in number of light emitting cells arranged in alignment with fine intervals, each said light emitting cell array segment is being secured separately and independently from the other of said segments;

said light emitting cell array segments forming a strip form physical region consisted of n in number of said light emitting cell array segments in spaced apart relationship to each other;

n in number of said light emitting cell array segments forming said strip form physical region being spaced from adjacent segments with an interval which is much greater than said interval between said light emitting cells;

(m×n) in number of said light emitting cells included in said strip form physical region being driven according to bitmap form image data with scrolling the display image from one end of said strip form physical region to the other end;

said bitmap type image data being prepared with respect to a virtual display region of which pixels are arranged in m dots in a column direction and w dots in a row direction, the w being integer multiple of n; and (m×n) dots light emitting cells being driven by (m×n) dot of data in said strip form physical region which is nominally regarded as said virtual display region.

11. A scrolling display system comprising:

a plurality of light emitting cell array segments, each being formed with m in number of light emitting cells arranged in alignment with fine intervals, said light emitting cell array segments being coupled together through a collapsible link mechanism allowing said segments to gather close proximity with each other, being attached to a flexible elongated sheet, or being connected with each other by a plurality of flexible strips;

said light emitting cell array segments forming a strip form physical region consisted of n in number of said light emitting cell array segments in spaced apart relationship to each other;

n in number of said light emitting cell array segments forming said strip form physical region being spaced from adjacent segments with an interval which is much greater than said interval between said light emitting cells;

(m×n) in number of said light emitting cells included in said strip form physical region being driven according to a bitmap form image data with scrolling the display image from one end of said strip form physical region to the other end;

said bitmap form image data being prepared with respect to a virtual display region of which pixels are arranged in m dots in a column direction and w dots in a row direction, the w being integer multiple of n; and (m×n) dots light emitting cells being driven by (m×n) dot of data in said strip form physical region which is nominally regarded as said virtual display region.

12. A scrolling display system comprising:

a plurality of light emitting cell array segments, each being formed with a plurality of light emitting cells arranged in alignment with a given smaller interval d1, said light emitting cell array segments being arranged in parallel with a given larger interval d2 which is multiple of d1 or more, each said light emitting cell array segment being secured separately and independently from the other of said segments;

a bitmap image data having columns with dot construction corresponding to respective light emitting cells in said light emitting cell array segments; and said light emitting cell array segments being driven by supplying data for respective columns in said image data for displaying, with a time difference being provided for column data to be supplied to respective light emitting cell array segments in such a manner that when (i)th column of said light emitting cell array segment is driven with (j)th column data for display. (i+1)th column of said light emitting cell array segment is driven with (j–a)th column data, where i is a number given for said light emitting cell array segments in order of arrangement, j is a number given to respective column data of said image data, and a is an integer to be arbitrarily set at a value greater than or equal to two.

13. A scrolling display system comprising:

a plurality of light emitting cell array segments, each being formed with a plurality of light emitting cells arranged in alignment with a given smaller interval d1, said light emitting cell array segments being arranged in parallel with a given larger interval d2 which is multiple of d1 or more, said light emitting cell array segments being coupled together through a collapsible link mechanism allowing said segments to gather close proximity with each other, being attached to a flexible elongated sheet, or being connected with each other by a plurality of flexible strips;

bitmap image data having columns with dot construction corresponding to respective light emitting cells in said light emitting cell array segments;

said light emitting cell array segments being driven by supplying data for respective columns in said image data for displaying, with a time difference being provided for column data to be supplied to respective light emitting cell array segments in such a manner that when (i)th column of said light emitting cell array segment is driven with (j)th column data for display, (i+1)th column of said light emitting cell array segment is driven with (j–a)th column data, wherein 1 is a number given for said light emitting cell array segments in order of arrangement, j is a number given to respective column data of said image data, and a is an integer to be arbitrarily set at a value greater than or equal to two.

14. A scrolling display method comprising the steps of:

forming a light emitting cell array segment by arranging a plurality of light emitting cells in a spaced apart with a first interval and aligned relationship;

arranging a plurality of said light emitting cell array segments in spaced apart relationship with a second interval greater than said first interval to form a display plane said light emitting cell array segments being arranged in parallel relationship on a common plane with different intervals at different positions on said display plane;

storing an image data representative of an image to be displayed on said display plane;

reading out data fractions of said image data, each of said data fraction corresponding to an image fraction to be displayed on one individual light emitting cell array segment, with thinning data fractions corresponding to the image fractions to be displayed in a space corresponding to the second intervals; and shifting the position of said image on said display plane in a predetermined magnitude per every display cycle for scrolling display of said image at a scroll speed determined depending upon said second interval.

15. A scrolling display method comprising the steps of:

forming a light emitting cell array segment by arranging a plurality of light emitting cells in a spaced apart with a first interval and aligned relationship;

arranging a plurality of said light emitting cell array segments in spaced apart relationship with a second interval greater than said first interval to form a display plane;

storing an image data representative of an image to be displayed on said display plane;

reading out data fractions of said image data, each of said data fraction corresponding to an image fraction to be displayed on one individual light emitting cell array segment, with thinning data fractions corresponding to the image fractions to be displayed in a space corresponding to the second intervals; and shifting the position of said image on said display plane in a predetermined magnitude per every display cycle for scrolling display of said image at a scroll speed determined depending upon said second interval, said scroll speed being proportional to said second interval versus said first interval.

16. A scrolling display system comprising:

a plurality of light emitting cell array segments, each being consisted of a given number of light emitting cells arranged in alignment with a given dot interval, said plurality of light emitting cell array segments being arranged in one of column and row directions in spaced apart relationship for forming a display plane, an interval of adjacent light emitting cell array segments being greater than said given dot interval, said light emitting cell array segment being secured separately and independently from the other of said segments;

an image memory storing an image data to be displayed on said display plane, said image data containing pixel information for all pixels to form dot matrix on said display plane with said given dot interval in column and row directions; and a display controller reading out data fractions of said image data corresponding to respective of light emitting cell array segments and supplying the data fractions to respective light emitting cell array segments for driving light emitting cell array segments, said display controller controlling shifting of display image in said one of column and row directions for adjusting scroll speed depending upon said interval between adjacent light emitting cell array segments.

17. A scrolling display system comprising:

a plurality of light emitting cell array segments, each being consisted of a given number of light emitting cells arranged in alignment with a given dot interval, said plurality of light emitting cell array segments being arranged in one of column and row directions in spaced apart relationship for forming a display plane, an interval of adjacent light emitting cell array segments being greater than said given dot interval, said light emitting cell array segments being coupled together through a link mechanism shifting adjacent light emitting cell array segments for varying relative position therebetween for forming said display plane at the expanded position, being fixed on a flexible sheet with said interval greater than said given dot interval, or and being connected with each other by a plurality of flexible strips with said interval greater than said given dot interval;

an image memory storing an image data to be displayed on said display plane, said image data containing pixel information for all pixels to form dot matrix on said display plane with said given dot interval in column and row directions; and a display controller reading out data fractions of said image data corresponding to respective of light emitting cell array segments and supplying the data fractions to respective light emitting cell array segments for driving light emitting cell array segments, said display controller controlling shifting of display image in said one of column and row directions for adjusting scroll speed depending upon said interval between adjacent light emitting cell array segments.

18. A scrolling display system comprising:

a plurality of light emitting cell array segments, each being consisted of a given number of light emitting cells arranged in alignment with a given dot interval, said plurality of light emitting cell array segments being arranged in one of column and row directions in spaced apart relationship for forming interval between the adjacent light emitting cell array segments being integer multiple of said given dot interval;

an image memory storing an image data to be displayed on said display plane, said image data containing pixel information for all pixels to form dot matrix on said display plane with said given dot interval in column and row directions; and a display controller reading out data fractions of said image data corresponding to respective of light emitting cell array segments and supplying the data fractions to respective light emitting cell array segments for driving light emitting cell array segments, said display controller controlling shifting of display image in said one of column and row directions for adjusting scroll speed depending upon said interval between adjacent light emitting cell array segments.

* * * * *